US011849823B2

(12) United States Patent
Cook

(10) Patent No.: US 11,849,823 B2
(45) Date of Patent: Dec. 26, 2023

(54) TSK—TRAVEL SAFETY KIT

(71) Applicant: Peter Thomas Cook, Winter Garden, FL (US)

(72) Inventor: Peter Thomas Cook, Winter Garden, FL (US)

( * ) Notice: Subject to any disclaimer, the term of this patent is extended or adjusted under 35 U.S.C. 154(b) by 559 days.

(21) Appl. No.: 16/869,409

(22) Filed: May 7, 2020

(65) Prior Publication Data

US 2020/0405026 A1 Dec. 31, 2020

Related U.S. Application Data

(60) Provisional application No. 62/921,594, filed on Jun. 27, 2019.

(51) Int. Cl.
*A45C 11/00* (2006.01)
*A45C 3/00* (2006.01)

(52) U.S. Cl.
CPC ..... *A45C 11/00* (2013.01); *A45C 3/001* (2013.01); *A45C 11/008* (2013.01); *A45C 2011/007* (2013.01); *A45C 2200/10* (2013.01)

(58) Field of Classification Search
CPC . A45C 11/008; A45C 2011/007; A45C 3/001; A45C 2200/10
See application file for complete search history.

(56) References Cited

U.S. PATENT DOCUMENTS

| | | | | |
|---|---|---|---|---|
| 8,607,972 | B2 | 12/2013 | Maclean et al. | |
| 9,578,938 | B1 | 2/2017 | Verneuille | |
| 2009/0046956 | A1* | 2/2009 | Redzisz | A45C 11/008 383/61.3 |
| 2013/0299382 | A1 | 11/2013 | Mullis | |
| 2014/0374302 | A1 | 12/2014 | Godshaw et al. | |

OTHER PUBLICATIONS

USPTO Office action dated Apr. 21, 2022 in related U.S. Appl. No. 15/931,044; 9 pages.

Convenience Kits International Women's Premium 21-Piece Kit with Travel Size TSA Compliant Essentials; https://www.amazon.com/dp/B00INVCHCC/?coliid=IL0X0VIZSRDYR&colid=1W4FOW1HFC9N0&ref_=lv_ov_it&th=1 (Year: 2018).

https://ckanani.com/blog, How to Organize Your Travel Toiletry Bag to Ensure You Never Forget Something: dated Feb. 28, 2019, https://ckanani.com/blog/organize-your-travel-toiletry-bag-never-forget-something https//ckanani.com/blog/organize-your-travel-toiletry-bag-never-forget-something (Year: 2019).

* cited by examiner

*Primary Examiner* — Sue A Weaver

(57) ABSTRACT

A travel kit including a bag containing there within three items selected from the group consisting of: a face sheet mask, multi-pack flushable and biodegradable wet wipes, facial tissues, a pillowcase, facial cleaning towelettes, a hydration mist dispenser, an eye mask, lip and eye covers, foot covers, hand sanitizer, a face mask, one of an N95 or KN95 respirator, lip balm, and spray disinfectant.

14 Claims, 23 Drawing Sheets

200

300

600

700

800

900

1100

1300

1500

1600

Details

1. TSA Compliant Clear PVC Quartz Sized Bag
2. Face Sheet Masks
3. Flushable + Blodegradable Wet Wipe
4. Facial tissues
5. Silk Pillowcase
6. Facial Cleaning Towelettes
7. Hydrating Mist (travel size)
8. Eye Covers
9. Lip & Eye Masks
10. Foot covers/booties/ Socks.
11. Hand Sanitizer (Travel size)
12. Face Masks
13. Respirators N95 Or KN 95
14. Lip Balm
15. Spray Disinfectant (Travel size)
16. Details Page

Fig 16

2200

Details

17.TSA Compliant Clear PVC Quartz Sized Bag
with Wet wipes, Hand sanitizer and Face mask
18.TSA Compliant Clear PVC Quartz Sized Bag
with Lip balm, Eye mask and Tissues
19.TSA Compliant Clear PVC Quartz Sized Bag
with Respirator, Silk pillow case and Disinfectant spray
20.TSA Compliant Clear PVC Quartz Sized Bag
with Face Sheet Masks ,Hydrating Mist, Foot cover
21.TSA Compliant Clear PVC Quartz Sized Bag
with Facial Cleaning Towelettes,Eye Covers or Eye Mask
22.Details page

Fig 22

2300

1. TSA Compliant Clear PVC Quartz Sized Bag with

Three Of Following Items Inside the bag :

2. Face Sheet Masks
3. Flushable + Blodegradable Wet Wipe
4. Facial tissues
5. Silk Pillowcase
6. Facial Cleaning Towelettes
7. Hydrating Mist (travel size)
8. Eye Mask
9. Lip & Eye Covers
10. Foot covers/booties/ Socks.
11. Hand Sanitizer (Travel size)
12. Face Masks
13. Respirators N95 Or KN 95
14. Lip Balm
15. Spray Disinfectant (Travel size)

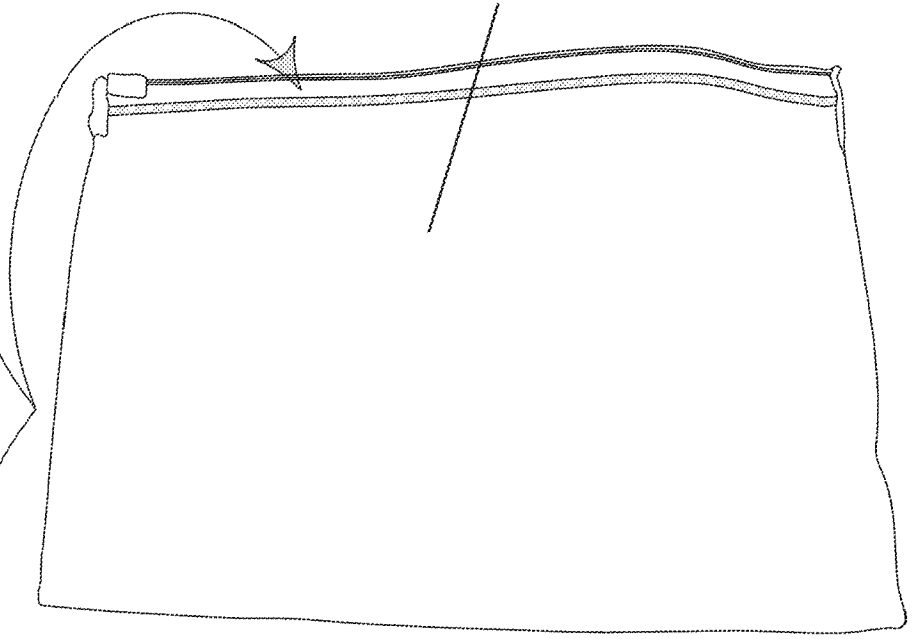

Fig 23

TSK—TRAVEL SAFETY KIT

CROSS REFERENCE TO RELATED APPLICATIONS

The present application claims priority to U.S. Provisional Patent Application No. 62/921,594 filed on Jun. 27, 2019.

FIELD OF THE INVENTION

The present disclosure relates to a kit and more particularly to an application specific kit and its related method.

BACKGROUND OF THE INVENTION

This section provides background information related to the present disclosures as well as providing a general summary of the disclosure and is or a comprehensive disclosure of its full scope or all it features.

The present invention relates to a portable beauty, health, safety, and comfort kit. More specifically, a TSA compliant clear PVC quartz size bag that consists of three travel essentials products designed to keep people relaxes healthy/beautiful and comfortable on the go.

The explosion in travel has created opportunities like never seen before in the world. With cheap flight, we live in an interconnected world where with at the click of a button you can have a cheap flight across the globe. The opportunity to travel and explore has never been greater! With discount and budget airlines, cruise ships, hotel and now a gig economy with Uber and Airbnb traveling has never been easier. People travel more often now than ever before and with so much time spent traveling the need to stay relaxed, healthy/beautiful, and comfortable has never been greater, People are constantly on the go and the world is overcrowding.

Conventional kits and first aid kit are marketed and sold for wound care and emergencies. They typically include bandages and medical supplies. These components are typically generic and designed to address a wide range of injuries and conditions and conventional kits have a wide arrange of applications. Because conventional kits are generic and may be used in virtually any household or business, with these kits often include bandages, medications, and/or a range of products. Likewise, such kits often contain medication.

Emergency and germs kits are specific and limited in scope. These are typically housed in containers made of polyethylene and have a wide range in size and color. Products are typically single use and specific in use, wounds, flu, germs, medical care. Likewise, such kits often include a range of products designed for medical conditions.

The present invention provides a single kit, the TSK—Travel Safety Kit which has the 3 essential products you need in a ISA compliant dear PVC quartz size bag to help one relax, stay healthy/beautiful and comfortable traveling. Due to the overall size and restrictions and limitations of other kits, we have invented the TSK—Travel Safety Kit and the summary are intended for purposes of illustration only and are not intended to limit the scope of the present disclosure.

SUMMARY OF THE INVENTION

TSK—Travel Safety Kit is an application specific for the relaxation, healthy/beauty, and comfort of a traveler. The TSK—Travel Safety Kit with its three essential travel products in a TSA Compliant dear PVC quartz size bag. This Grab & Go filled with reusable and multi-pack travel essential items is necessary for health, wellness and beauty when traveling. The essential products include: face sheet mask (24K gold, hydration-collagen, K-Beauty), multi-pack flushable & Biodegradable wet wipes, tissues, silk or satin pillowcase, facial cleaning towelettes, hydration mist, eye mask, lip & eye covers, socks/booties/foot covers, hand sanitizer, face mask, N95 or KN95 respirator, lip balm and/or spray disinfectant to keep a travelers relax, stay healthy/beautiful, and comfortable.

Further below you will find specific examples intended for the purposes of illustration and are not intended to limit the scope of the present disclosure. Other items can and will be added as they are invented and become available.

BRIEF DESCRIPTION OF THE DRAWINGS

Some embodiments of the present invention are illustrated as an example and are not limited by the figures of the accompanying drawings, in which like references may indicate similar elements.

FIG. 16 is a front elevation view of an inventory list of the contents of a travel bag comprised by a travel bag according to an embodiment of the invention.

FIG. 22 is a front elevation view of an inventory of the contents of a travel bag comprised by a travel bag according to an embodiment of the invention.

FIG. 23 is a front elevation view of a travel kit comprising a ISA-compliant clear PVC quart-size bag and three essentials travel products according to an embodiment of the invention.

DETAILED DESCRIPTION OF THE INVENTION

Figure 1:
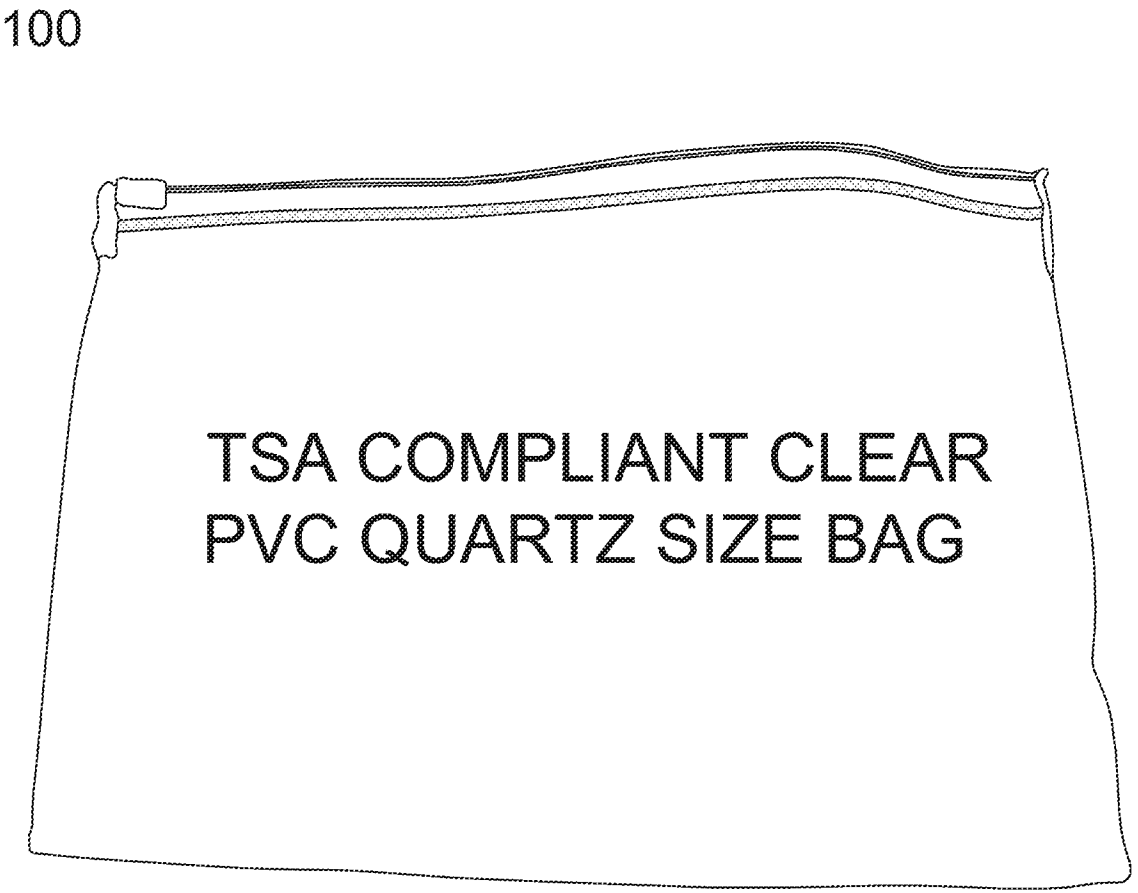
FIG. 1 is a front elevation view of a travel bag/container that is a TSA-compliant clear/transparent PVC quart-size bag according to an embodiment of the invention.

The invention and accompanying embodiments will be described in detail the specific embodiments more fully with reference to the drawing illustrated and described.

With reference to the figures, a kit 100 as shown in FIG. 1 is a diagramed drawing and shows the embodiments of this TSA compliant clear PVC quartz size bag. The kit is made of Polyvinyl chloride (PVC). The Kit measurements are compliant with the Transportation Security Administration (TSA) which requires a bag be dear and measure no more than 9 inches long and 6 inches high (quart-size bag) for security measures and precautions.

Figure 2:
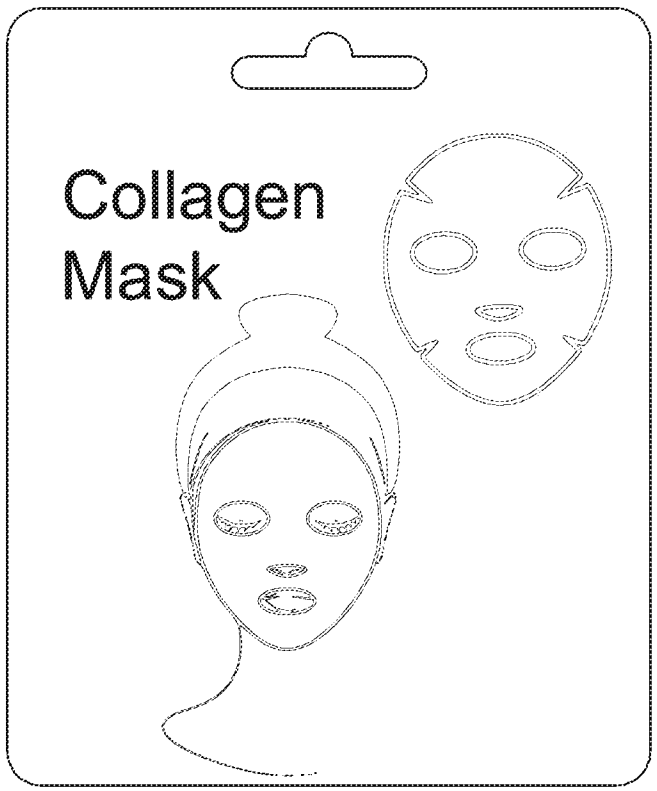
FIG. 2 is a front elevation view of a face sheet mask that may be comprised by a travel bag according to an embodiment of the invention.

Further components of the kit are shown outside of the containing bag for illustration. These fourteen travel essentials include the following components:

A single-pack or multi-pack collagen mask 200 as may be comprised in a kit according to an embodiment of the invention is depicted in FIG. 2. The masks include at least one of, face and beauty masks, 24K gold face masks, K-Beauty face masks, hydration masks and collagen masks.

Figure 3:
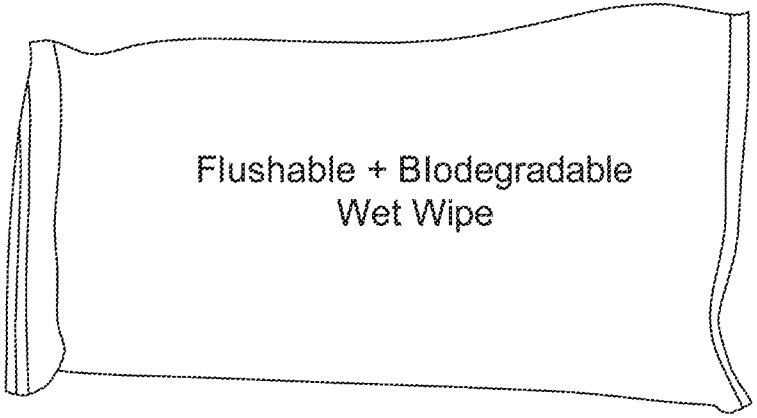
FIG. 3 is a front elevation view of a multi-pack flushable and biodegradable wet wipes that may be comprised by a travel bag according to an embodiment of the invention.

Referring now to FIG. 3, a package of 8 or 10 count of flushable and biodegradable wet wipes 300 that may be comprised by a kit according to an embodiment of the inventions is depicted. The wipes are biodegradable and flushable and come in packages of 8 to 10 sheets. The wipes are to help travelers clean their hand on the go and not leave an environmental impact.

Figure 4:
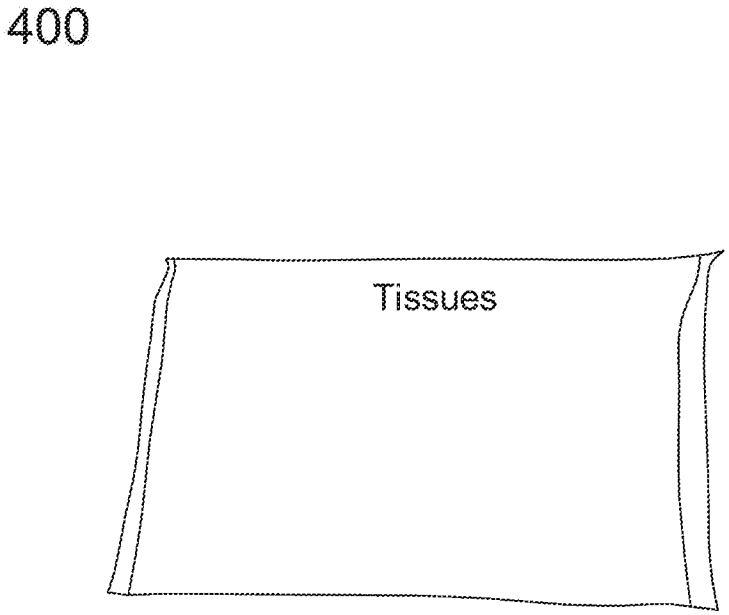
FIG. 4 is a front elevation view of a travel size package of tissues that may be comprised by a travel kit according to an embodiment of the invention.

Referring now to FIG. 4, a package of 8 to 10 count soft white 3 or 4-ply facial tissues 400 that may be comprised by a kit according to an embodiment of the invention is depicted.

Figure 5:
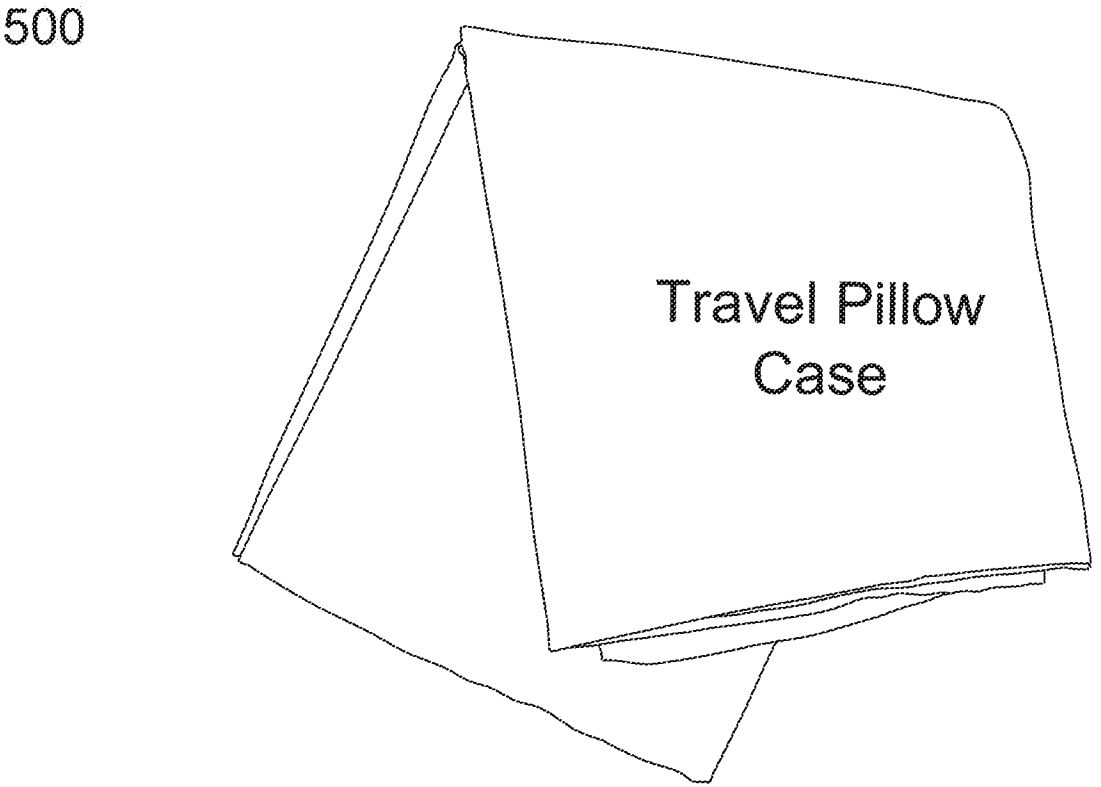
FIG. 5 is a front elevation view of a travel pillow case that may be comprised by a travel bag according to an embodiment of the invention.

Referring now to FIG. 5, a travel size pillowcase 500 that may be comprised by a kit according to an embodiment of the invention is depicted. The pillowcase 500 may be made of silk or satin. The pillowcase 500 can be filled with a travel pillow or with clothing during a trip for comfort. It can also double as a headrest as well as a face mask.

Figure 6:
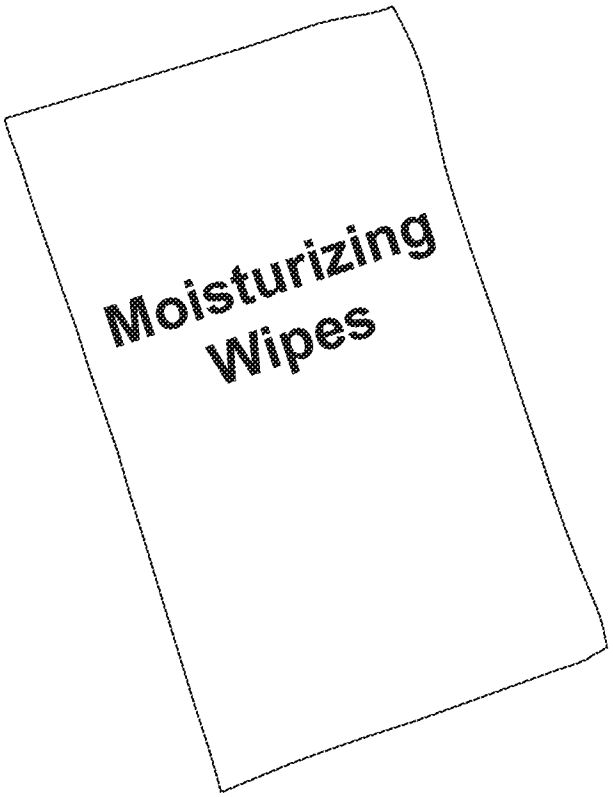
FIG. 6 is a front elevation view of a package containing moisturizing wipes that may be comprised by a travel bag according to an embodiment of the invention.

Referring now to FIG. 6, a packet of moisturizing wipes 600 that may be comprised by a kit according to an embodiment, of the invention is depicted. The disposable wipes 600 are infused with moisturizing body lotion to revive, regenerate, and repair the skin.

Figure 7:
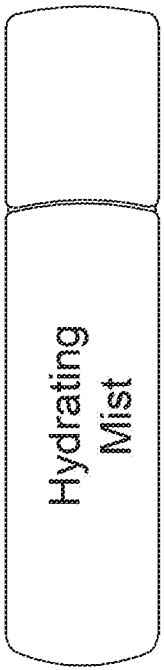
FIG. 7 is a front elevation view of a dispenser of hydration mist spray that may be comprised by a travel bag according to an embodiment of the invention.

Referring now to FIG. 7, a travel size hydrating mist dispenser 700 that may be comprised by a kit according to an embodiment of the invention is presented. In some embodiments, the hydrating mist dispenser 700 may alternatively, or additionally, be a refreshing spray and/or a purifying mist. The hydrating mist dispenser 700 maybe of a size of no less than 1 oz and no more than 3 oz. The substance dispensed by the hydrating mist dispenser 700 may be used to prevent dry skin and help maintain a healthy complexation when traveling.

Figure 8:
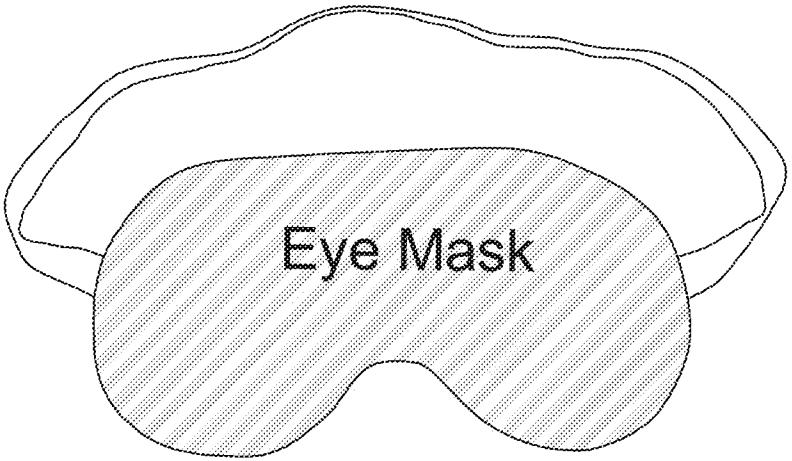
FIG. 8 is a front elevation of an eye mask that may be comprised by a travel bag according to an embodiment of the invention.

Referring now to FIG. 8, a travel eye mask 800 that may be comprised by a kit according to an embodiment of the invention is presented. The eye mask 800 may be individually packaged, made of satin or silk, and designed to be light for rest, sleep, and relaxation when traveling. The eye mask 800 may have an adjustable head band for comfort.

Figure 9:
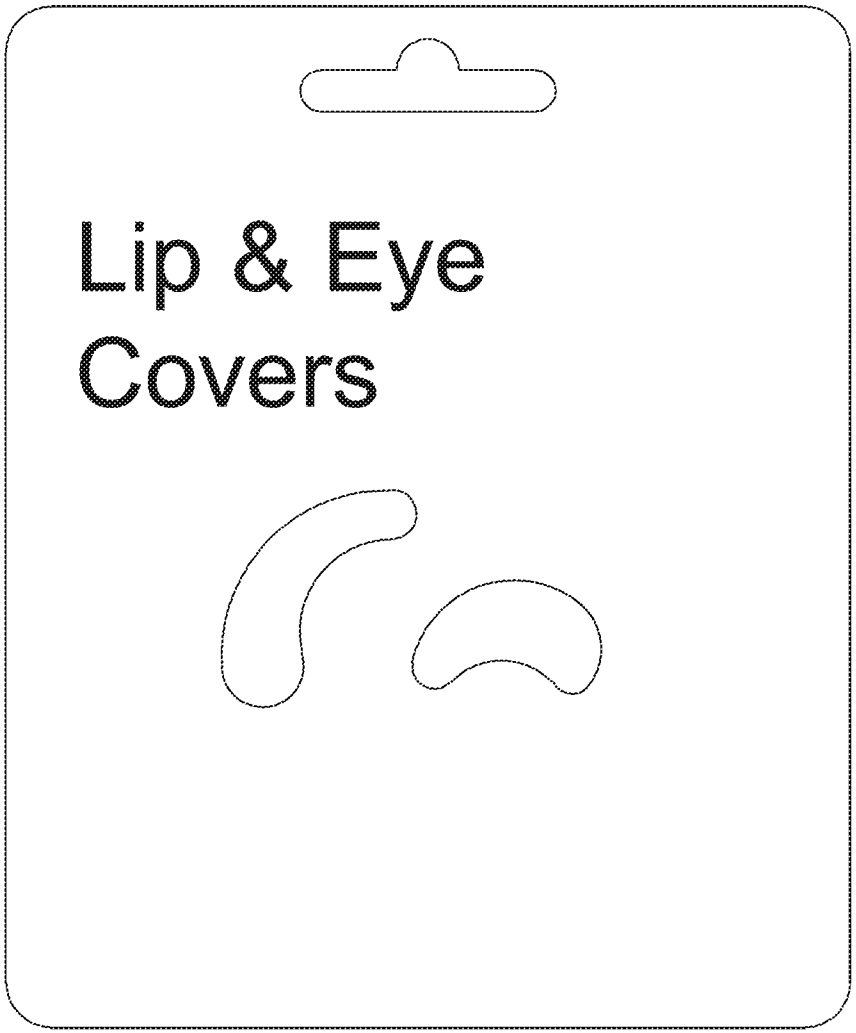
FIG. 9 is a front elevation view of lip and eye mask covers that may be comprised by a travel bag according to an embodiment of the invention.

Referring now to FIG. 9, a package of lip and eye covers 900 that may be comprised by a kit according to an embodiment of the invention is presented. These antiwrinkle, anti-aging, lip and eye covers 900 can be moisturizing collagen, 24K gold, hyaluronic acid, charcoal, green tea as well as rose and others. They will be packaged and sealed in single or multi-unit packs.

Figure 10:
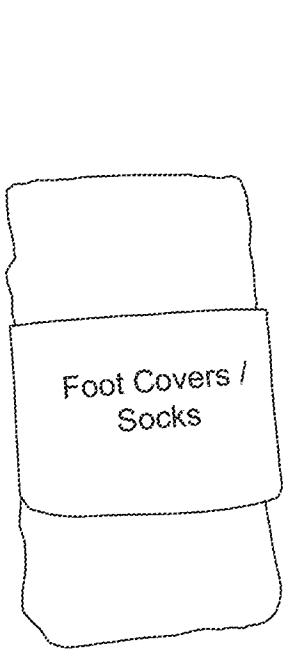
FIG. 10 is a front elevation view of foot covers that may be comprised by a travel bag according to an embodiment of the invention.

Referring now to FIG. 10, a pair of foot covers 1000, also known as booties or socks, that may be comprised by a kit according to an embodiment of the invention is presented. These covers 1000 of your feet or shoes can be reusable or disposable. Single or multiple use, for travelers to protect their feet when walking through TSA security, or taking their shoes off on a plane, elevation has been known to cause swelling in your feet.

Figure 11:
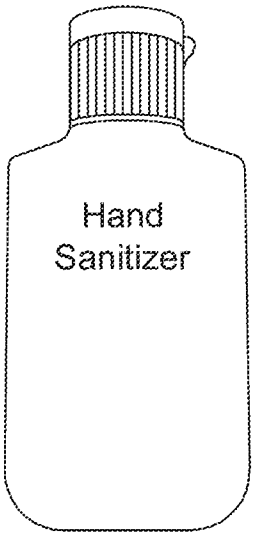
FIG. 11 is a front elevation view of a travel-sized container of hand sanitizes that may be comprised by a travel bag according to an embodiment of the invention.

Referring now to FIG. 11, a 2 oz. bottle of antibacterial hand sanitizer 1100 that may be comprised by a kit according to an embodiment of the invention is presented. In some embodiments, the hand sanitizer 1100 may comprise aloe. With airlines known to infrequently clean their plane, having a waterless hand cleaning option is always helpful for healthy/beautiful and comfortable on the go. The container containing the hand sanitizer 1100 may be made from polyethylene terephthalate (PET) and/or of recycled material.

Figure 12:
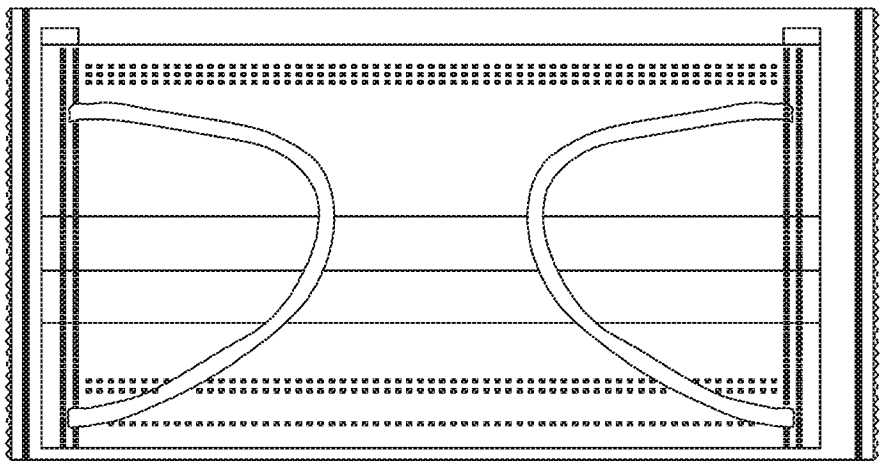
FIG. 12 is a front elevation view of a face sheet mask that may be comprised by a travel kit according to an embodiment of the invention.

Referring now to FIG. 12, a fashion mask or 3 or 4-ply face mask 1200 that may be comprised by a kit according to an embodiment of the invention is presented. The face mask 1200 may be configured to prevent the wearer from breathing the recycled air on airplanes and to stay healthy/beautiful and comfortable on their travels.

Figure 13:
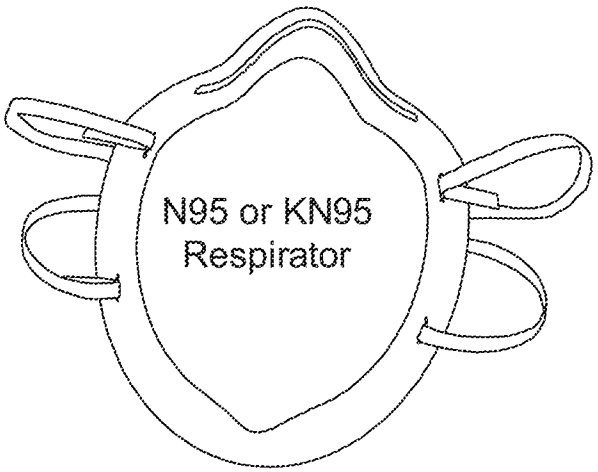
FIG. 13 is a front elevation view of an N95/KN95 respirator hat may be comprised by a travel bag according to an embodiment of the invention.

Referring now to FIG. 13, a single package of one KN95 or N95 face mask 1300 that may be comprised by a kit according to an embodiment of the invention is presented. The face mask 1300 may be used to keep from breathing the recycled air on airplanes and to stay healthy/beautiful and comfortable on your travels.

Figure 14:
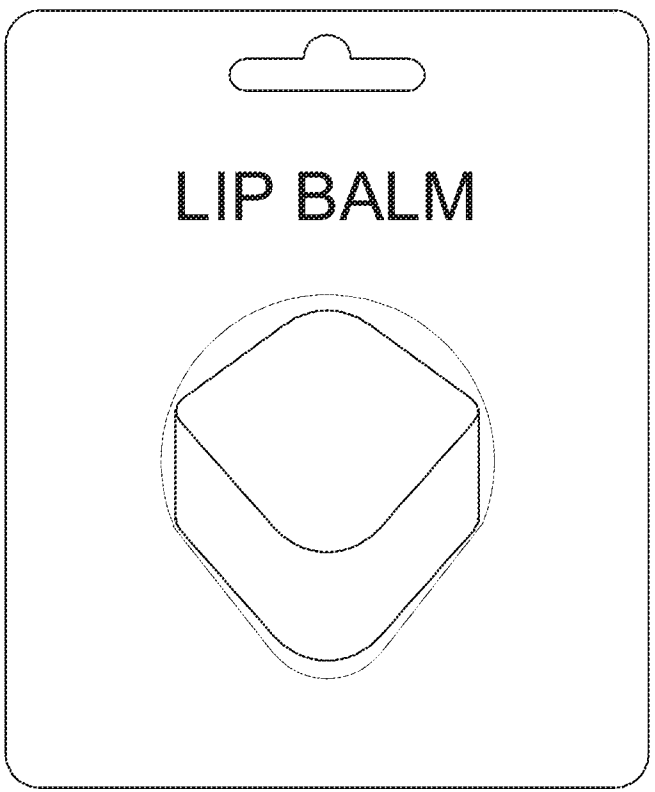
FIG. 14 is a front elevation view of a packaged lip balm that may be comprised by a travel bag according to an embodiment of the invention.

Referring now to FIG. 14, a package or tube of lip balm 1400 to nourish and moisturize your lips that may be comprised by a kit according to an embodiment of the invention is presented. The lip balm 1400 may be packaged or in a tube that self-packaged. The lip balm 1400 is for convenience when traveling to keep your lips from cracking in the dry air or airplane or in different climates.

Figure 15:
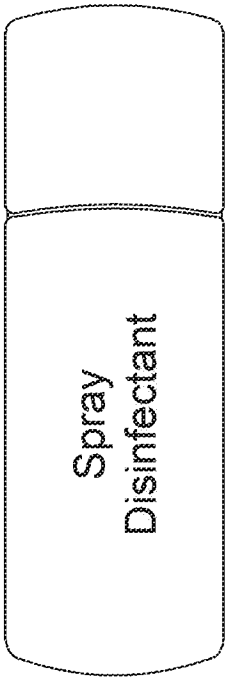
FIG. 15 is a front elevation view of a travel sized spray disinfectant dispenser that may be comprised by a travel bag according to an embodiment of the invention.

Referring now to FIG. 15, a travel size spray disinfectant 1500 that may be comprised by a kit according to an embodiment of the invention is presented, The disinfectant 1500 may be no more than 3 oz in size and made with both natural and/or chemicals and designed to inactivate or destroy microorganisms on inert surfaces, Referring now to FIG. 16, an inventory list 1600 listing each travel essential product that may be comprised by a kit according to an embodiment of the invention. The inventory list 1600 may have each of the fourteen items inside a traveler could have inside the TSA-compliant clear PVC quart-size bag.

Figure 17:
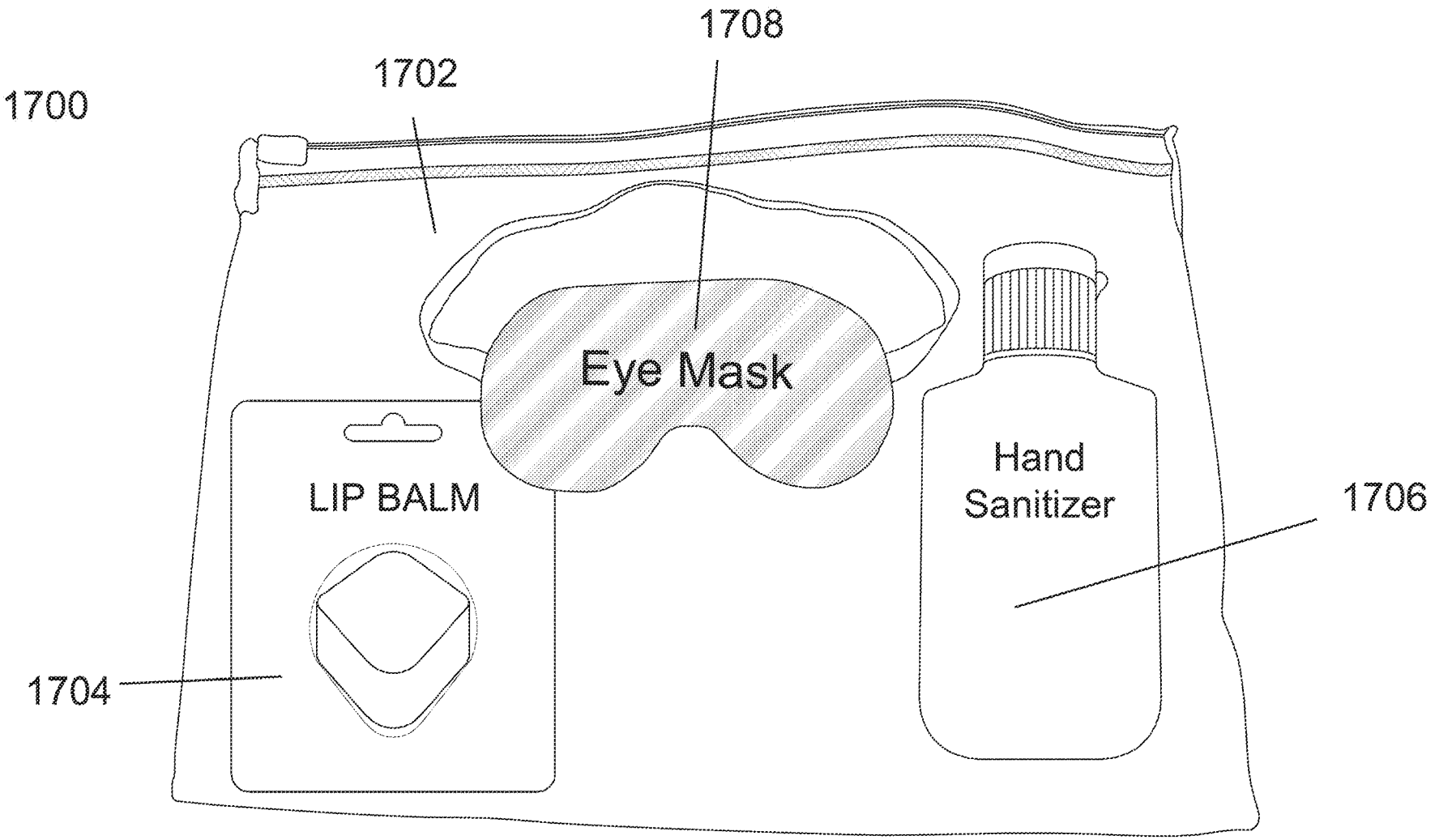
FIG. 17 is a front elevation view of a travel kit consisting of an eye mask, hand sanitizer, and lip balm in a ISA-compliant clear PVC quart-size bag according to an embodiment of the invention.

Referring now to FIG. 17, a kit 1700 according to an embodiment of the invention is presented. The kit 1700 may comprise a TSA-compliant clear PVC quart-size bag 1702 containing therein a package of moisturizing lip balm 1704, a 2 oz hand sanitizer with aloe 1704, and a satin or silk eye mask 1706 with adjustable head strap to relax and stay healthy/beautiful and comfortable on the go.

Figure 18:
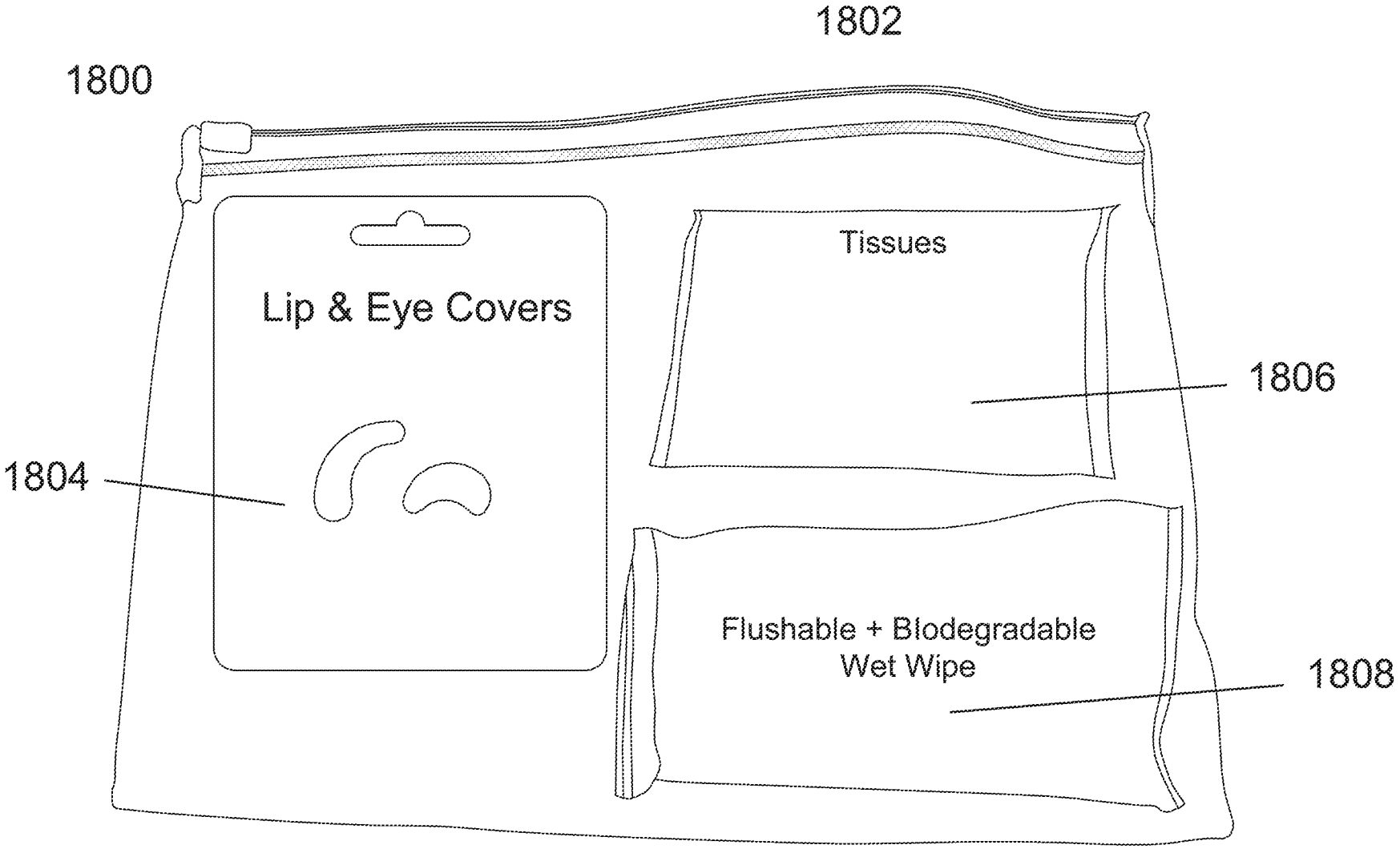
FIG. 18 is a front elevation view of a travel kit consisting of a lip and eye mask cover, tissues and flushable biodegradable multi-pack wet wipes in a TSA-compliant clear PVC quart-size bag according to an embodiment of the invention.

Referring now to FIG. 18, a kit 1800 according to an embodiment of the invention is presented. The kit 1800 comprises a TSA-compliant clear PVC bag 1802 containing therein a single package of lip and eye covers 1804, a 10 count of soft 3-ply white soft facial tissues 1806, and a 10 pack of flushable and biodegradable wet wipes 1808 in a 3 unit combination.

Figure 19:
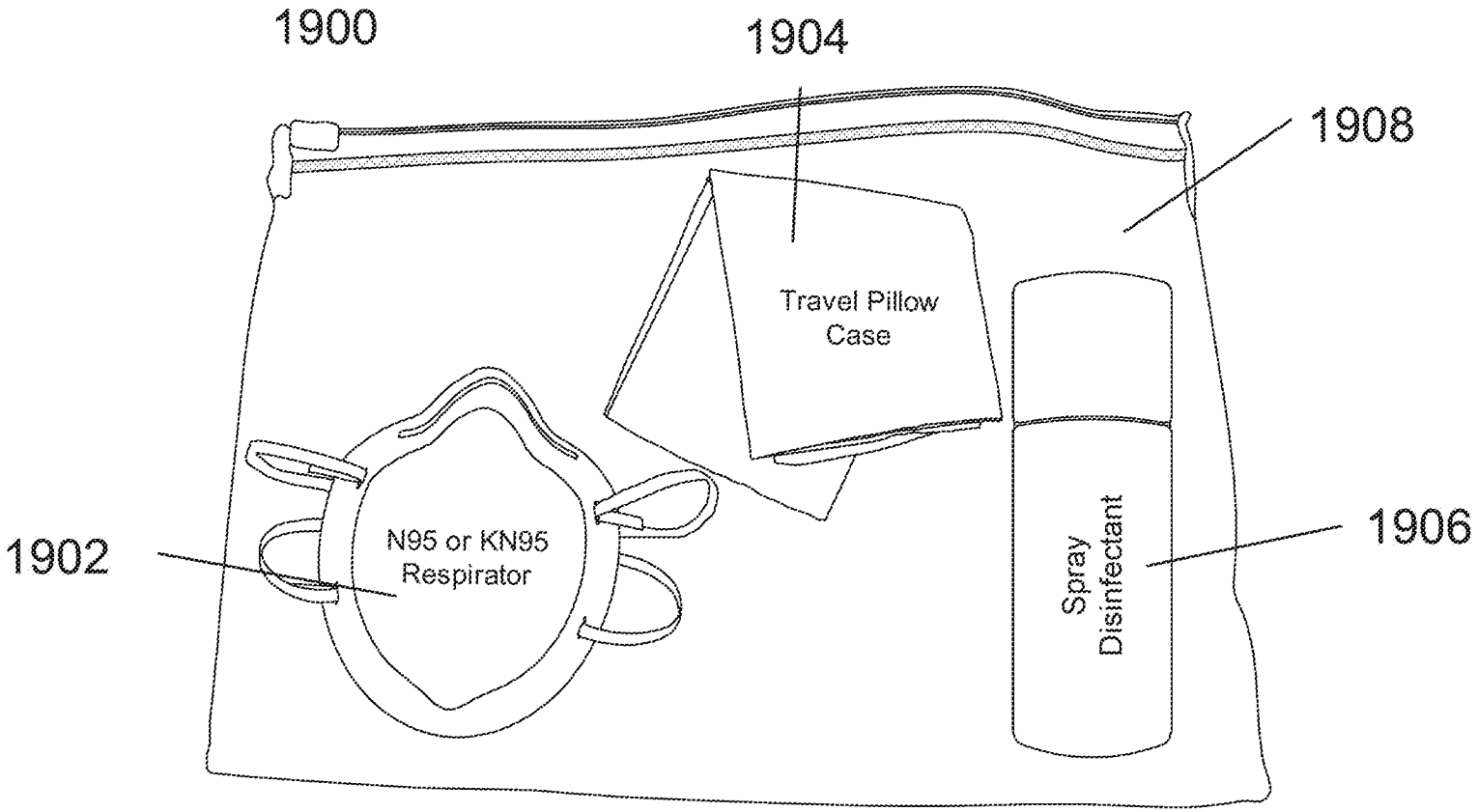
FIG. 19 is a front elevation view of a travel kit consisting of a travel pillowcase, an N95 or KN 95 face mask, and spray disinfectant in a TSA-compliant clear PVC Quart-size bag according to an embodiment of the invention.

Referring now to FIG. 19, a kit 1900 according to an embodiment of the invention is presented. The kit 1900 may be configured for individual preference and health and beauty needs. The kit 1900 comprises a KN95 respirator 1902, a satin/silk pillowcase 1904, and a travel size spray disinfectant 1906 contained within a TSA-compliant clear PVC quart-size bag 1908.

Figure 20:
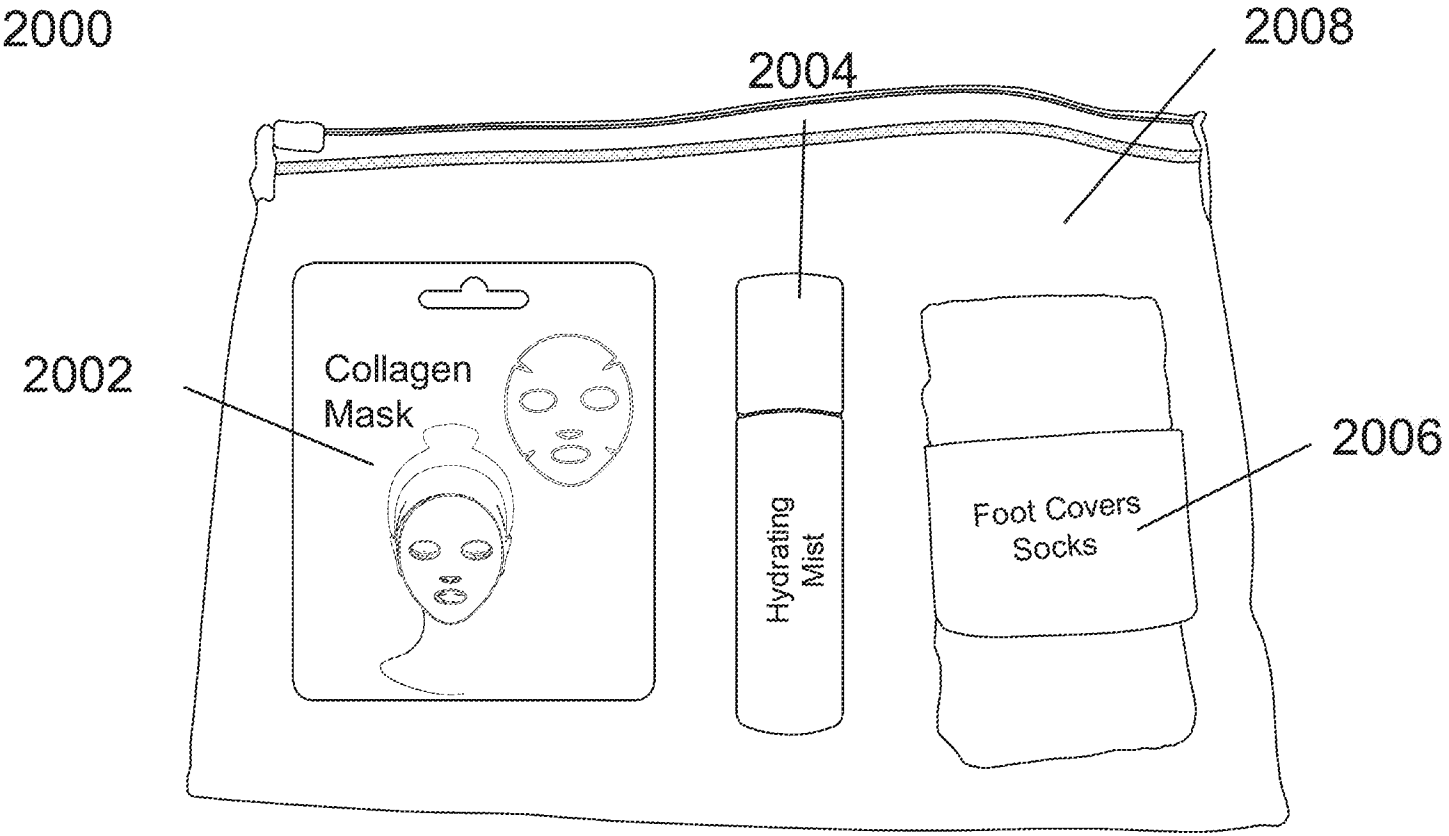
FIG. 20 is a front elevation view of a travel kit consisting of a face sheet mask, hydration mist, and foot covers in a ISA-compliant clear PVC quart-size bag according to an embodiment of the invention.

Referring now to FIG. 20, a kit 2000 according to an embodiment of the invention consists of collagen masks 2002, hydrating spray dispenser 2004, and a pair of foot covers 2006 contained within a TSA-compliant dear PVC quart-size bag 2008.

Figure 21:
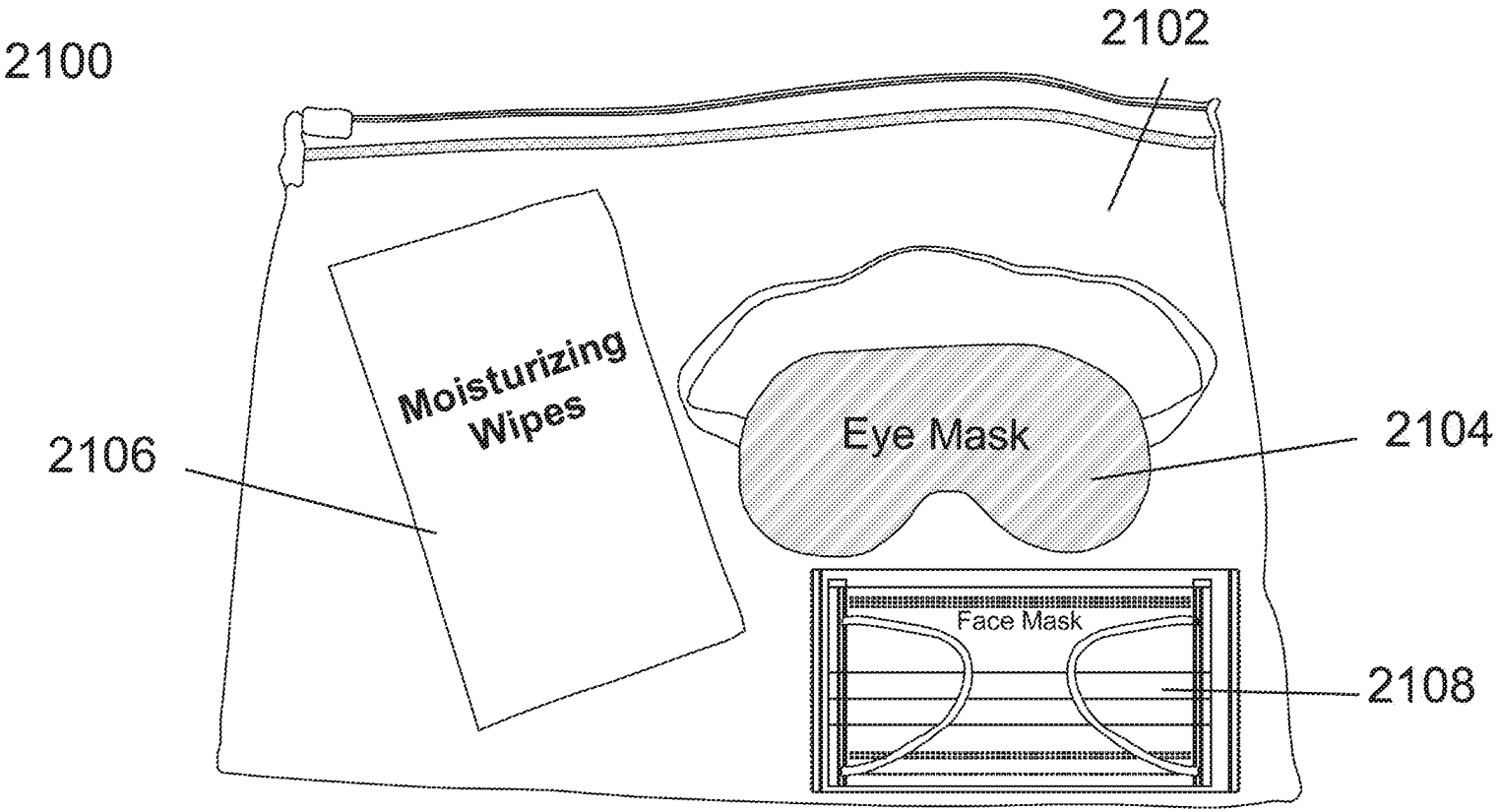
FIG. 21 is a front elevation view of a travel kit consisting of an eye mask, a face mask, and moisturizing wipes in a TSA-compliant clear PVC quart-size bag according to an embodiment of the invention.

Referring now to FIG. 21, a kit 2100 according to an embodiment of the invention consisting of a dear PVC quart-size TSA-compliant bag 2102 containing a packaged satin or silk eye mask 2104, with adjustable head band for comfort, one packet of moisturizing wipes 2106, and a fashion mask or face mask 2108. Referring now to FIG. 22, details about several embodiments of kits according to embodiments of the invention are presented. Referring now to FIG. 23, a kit 2300 according to an embodiment of the invention is presented. The kit 2300 consists of a TSA-compliant clear PVC quart-sized bag 2302 containing a combination of three travel essentials from the above-described essentials. The combination of products inside the kit 2300 will vary based on individual user preference and need as shown in the detailed depiction.

I claim:

1. A travel kit comprising:

a bag containing there within three items selected from the group consisting of: a face sheet mask multi-pack flushable and biodegradable wet wipes, facial tissues, a pillowcase, facial cleaning towelettes, a hydration mist dispenser, an eye mask, lip and eye covers, foot covers, hand sanitizer, a face mask, one of an N95 or KN95 respirator, lip balm, and spray disinfectant.

2. The kit of claim 1, wherein said bag is Travel Safety Administration compliant.

3. The kit of claim 1, wherein said bag is transparent.

4. The kit of claim 1, wherein said bag is constructed from polyvinyl chloride (PVC).

5. The kit of claim 1, wherein said bag is guartz size.

6. The kit of claim 1, wherein said bag comprises a logo depicted on an outer surface thereof.

7. The kit of claim 5 wherein the kit has outer dimensions of 9 inches by 6 inches.

8. A travel kit consisting of a bag containing there within three items selected from the group consisting of: a face sheet mask, multi-pack flushable and biodegradable wet wipes, facial tissues, a pillowcase, facial cleaning towelettes, a hydration mist dispenser, an eye mask, lip and eye covers, foot covers, hand sanitizer, a face mask, one of an N95 or KN95 respirator, lip balm, and spray disinfectant.

9. The kit of claim 8, wherein said bag is Travel Safety Administration compliant.

10. The kit of claim 8, wherein said bag is transparent.

11. The kit of claim 8, wherein said bag is constructed from polyvinyl chloride (PVC).

12. The kit of claim 8, wherein said bag is quartz size.

13. The kit of claim 8, wherein said bag comprises a logo depicted on an outer surface thereof.

14. The kit of claim 12 wherein the kit has outer dimensions of no more than 9 inches by 6 inches.

* * * * *